US010928766B2

(12) United States Patent
Tanaka et al.

(10) Patent No.: US 10,928,766 B2
(45) Date of Patent: Feb. 23, 2021

(54) STAPLING DEVICE AND RECORDING APPARATUS

(71) Applicant: SEIKO EPSON CORPORATION, Tokyo (JP)

(72) Inventors: Yoshiyuki Tanaka, Matsumoto (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/737,507

(22) Filed: Jan. 8, 2020

(65) Prior Publication Data

US 2020/0218192 A1 Jul. 9, 2020

(30) Foreign Application Priority Data

Jan. 9, 2019 (JP) ..... JP2019-001710

(51) Int. Cl.
*B65H 37/04* (2006.01)
*G03G 15/00* (2006.01)
*B42C 1/12* (2006.01)

(52) U.S. Cl.
CPC ..... *G03G 15/6541* (2013.01); *B42C 1/125* (2013.01); *B65H 37/04* (2013.01); *G03G 15/6544* (2013.01); *G03G 2215/00827* (2013.01); *G03G 2215/00848* (2013.01)

(58) Field of Classification Search
CPC ..... B42C 1/12; B65H 37/04; G03G 15/6544; G03G 2215/00827; G03G 2215/00848
USPC ..... 270/58.08
See application file for complete search history.

(56) References Cited

U.S. PATENT DOCUMENTS 6,173,949 B1 * 1/2001 Visick ..... B42C 1/00 227/119
6,199,852 B1 * 3/2001 Visick ..... B42C 1/00 227/2
6,565,075 B2 * 5/2003 Ishizaki ..... B27F 7/19 227/128
7,090,110 B2 * 8/2006 Adams ..... B25C 5/02 227/120
7,306,131 B2 * 12/2007 Bargo ..... B25C 5/02 227/110
2012/0153556 A1 6/2012 Sugiyama et al.

FOREIGN PATENT DOCUMENTS

JP 2012-126515 7/2012
JP 2018-077321 5/2018

* cited by examiner

*Primary Examiner* — Leslie A Nicholson, III
(74) *Attorney, Agent, or Firm* — Workman Nydegger

(57) ABSTRACT

In a stapling device, a first guide member and a second guide member are disposed one by one on both sides of a binding portion of the recording medium on a side of a recording medium placing of a placement table such that each of the guide members is rotatable, and the first guide member and the second guide member are rotatable between a first posture along a first direction in which one abutting end side extends and a second posture inclined with respect to the first direction in line symmetry with respect to an imaginary line that passes through the binding portion along a second direction orthogonal to the first direction.

9 Claims, 13 Drawing Sheets

STAPLING DEVICE AND RECORDING APPARATUS

The present application is based on, and claims priority from JP application Ser. No. 2019-001710, filed Jan. 9, 2019, the disclosure of which is hereby incorporated by reference herein in its entirety.

BACKGROUND

1. Technical Field

The present disclosure relates to a stapling device and a recording apparatus including the stapling device.

2. Related Art

In the related art, a stapling device that binds a plurality of sheets as recording media in a stacked state is known. As such a stapling device, for example, in JP-A-2012-126515, a sheet processing device is disclosed for binding sheets by determining a distance from an end surface of a sheet to a binding position, and by setting the binding position by moving the sheet by a sheet moving mechanism using a drive motor or the like.

However, in the sheet processing device of JP-A-2012-126515, the configuration and handling are complicated, for example, the binding position is set by moving the sheet by the sheet moving mechanism using the drive motor or the like after setting the distance from the end surface of the sheet to the binding position, and it is difficult for a user to easily determine the binding position and perform binding.

SUMMARY

According to an aspect of the present disclosure, there is provided a stapling device including: a main body section; a binding processing section that is provided at the main body section and has a function of binding a plurality of recording media at a binding portion located at an end portion of a recording medium of the plurality of recording medium; a pair of guide members that positions the plurality of recording media while an end side of the recording medium located outside the binding portion abuts against the guide members; and a placement table that is coupled to the main body section and has a placement surface on which the recording medium is placed, in which the guide members are disposed on both sides of the binding processing section on a side of the placement surface of the placement table such that the guide members are configured to each rotate, and are configured to rotate between a first posture along a first direction in which the end side that abuts against the guide members extends and a second posture inclined with respect to the first direction in line symmetry with an imaginary line that passes through the binding portion along a second direction orthogonal to the first direction in an extending direction of the placement surface.

In the stapling device, a base that is provided at an opposite side of the placemen table from a side where the guide members are arranged, and pivotally supports a pair of gears may further be provided, and each of the guide members may be coupled to each of the gears, may be pivotally supported by a shaft that penetrates the placement table, and may move between the first posture and the second posture by rotating the gear.

In the stapling device, the gear may be provided with a lever coupled to the gear, and by movement of the lever, the gear may rotate and the guide member may rotate.

In the stapling device, a support base that is attached to the main body section to be configured to move along the second direction, and to which the base is pivotally supported to be configured to rotate; and an operating section that is supported by the main body section in an opposite direction to the binding portion, in the second direction, may further be provided, and the support base may move in the second direction by a rotation operation of the operating section.

In the stapling device, a support base that is attached to the main body section to be configured to move along the second direction, and to which the base is pivotally supported to be configured to rotate; a pushing and pulling section that is coupled to the support base in an opposite direction to the binding portion, in the second direction; and a slide guide section that is provided in the main body section and guides movement of the pushing and pulling section along the second direction may further be provided, and the support base may move in the second direction by a pushing and pulling operation of the pushing and pulling section.

In the stapling device, the base may include a knob section configured to move the guide member in a rotational direction.

According to another aspect of the present disclosure, there is provided a stapling device including: a main body section; a binding processing section that is coupled to the main body section and has a function of binding a plurality of recording media at a binding portion located at an end portion of a recording medium of the plurality of recoding media; a pair of guide members that positions the plurality of recording media; and a placement table that is coupled to the main body section and has a placement surface on which the recording medium is placed, in which the guide members are disposed on both sides of the binding processing section, and have a first surface along a first direction in which one end side of the recording medium located outside the binding portion extends and a second surface that abuts against any of two end sides that form a corner portion of the recording medium when the recording medium is placed such that the corner portion is located on an imaginary line that passes through the binding portion along a second direction orthogonal to the first direction in an extending direction of the placement surface.

In the stapling device, a support base that is attached to the main body section such that the support base is configured to move along the second direction, may further be provided, and the guide member may be coupled to the support base and may move in the second direction together with the support base.

In the stapling device, an operating section that is supported by the main body section in an opposite direction to the binding portion, in the second direction, may further be provided, and the support base may move in the second direction by a rotation operation of the operating section.

In the stapling device, a pushing and pulling section that is coupled to the support base in an opposite direction to the binding portion, in the second direction; and a slide guide section that is provided at the main body section and supports the pushing and pulling section to be configured to slide, may further be provided, and the support base may move in the second direction by a pushing and pulling operation of the pushing and pulling section.

According to still another aspect of the present disclosure, there is provided a recording apparatus including: a recording section that performs recording on a recording medium; and the stapling device described in the description above.

DESCRIPTION OF EXEMPLARY EMBODIMENTS

Figure 1:
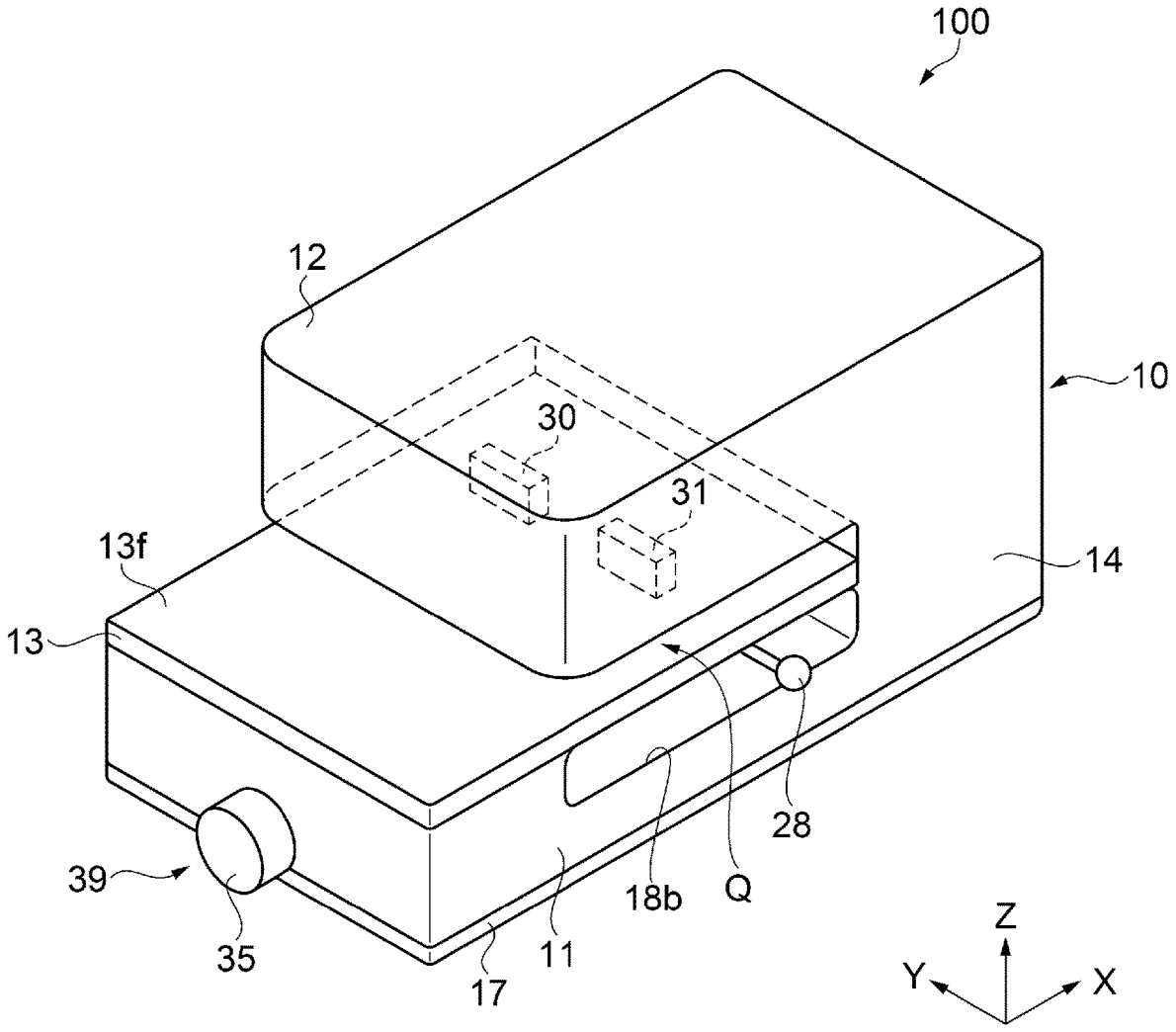
FIG. 1 is an external perspective view illustrating a schematic configuration of a stapling device according to a first embodiment.

Hereinafter, embodiments for carrying out the disclosure will be described in detail with reference to the drawings. In addition, the embodiments which will be described below do not inappropriately limit the contents of the disclosure described in the range of the claims. Further, not all of the configurations which will be described in the embodiments are necessarily essential components of the disclosure. Moreover, in each drawing to be referred to, the same reference numerals will be given to the same or corresponding parts, and there is a case where the overlapping description is simplified or omitted appropriately. In addition, in each drawing, for convenience of description, an X axis, a Y axis, and a Z axis are illustrated as three axes orthogonal to each other, and a tip end side is "+" and a base end side is "−" in arrows that indicate each axis. In the following description, a direction parallel to the X axis is referred to as "X direction", a direction parallel to the Y axis is referred to as "Y direction", and a direction parallel to the Z axis is referred to as "Z direction". The +Z axis side is also referred to as "up" or "upper", and the −Z axis side is also referred to as "low" or "lower". In addition, a placement surface of a placement table on which a recording medium is placed is provided along an XY plane, the X direction corresponds to a second direction and the Y direction corresponds to a first direction. Here, the first direction corresponds to a direction in which one end side of a recording paper sheet positioned on the tip end side with respect to an insertion direction when the recording sheet is inserted into a stapling device along the second direction in a state where four end sides of the recording paper sheet as the recording medium are substantially along the X axis and the Y axis. The term "orthogonal" here does not mean a strict right angle that intersects at 90 degrees, and may include an error of approximately 90 degrees ±5 degrees.

1. First Embodiment

Figure 2:
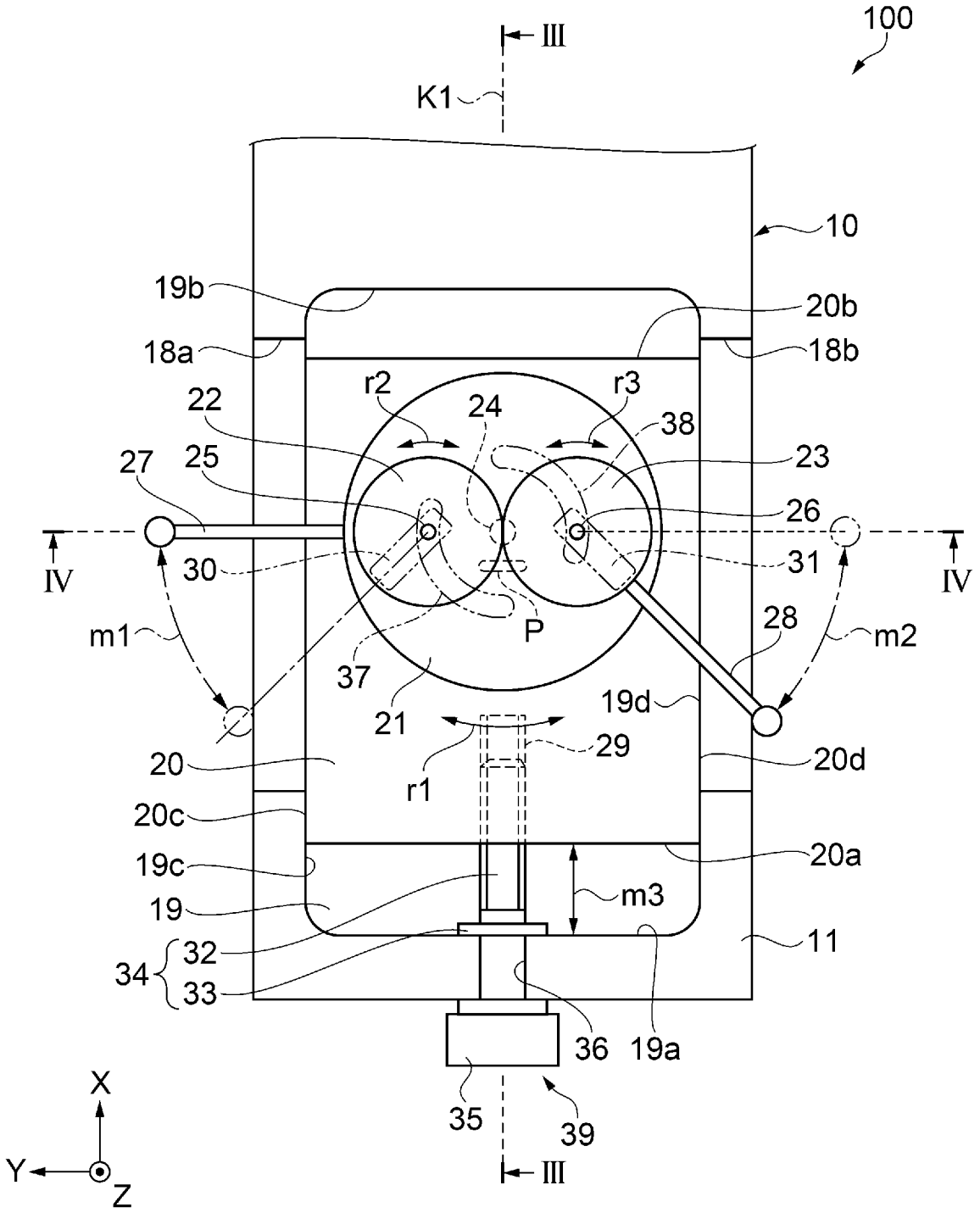
FIG. 2 is a plan view illustrating a schematic configuration of the stapling device according to the first embodiment.
Figure 3:
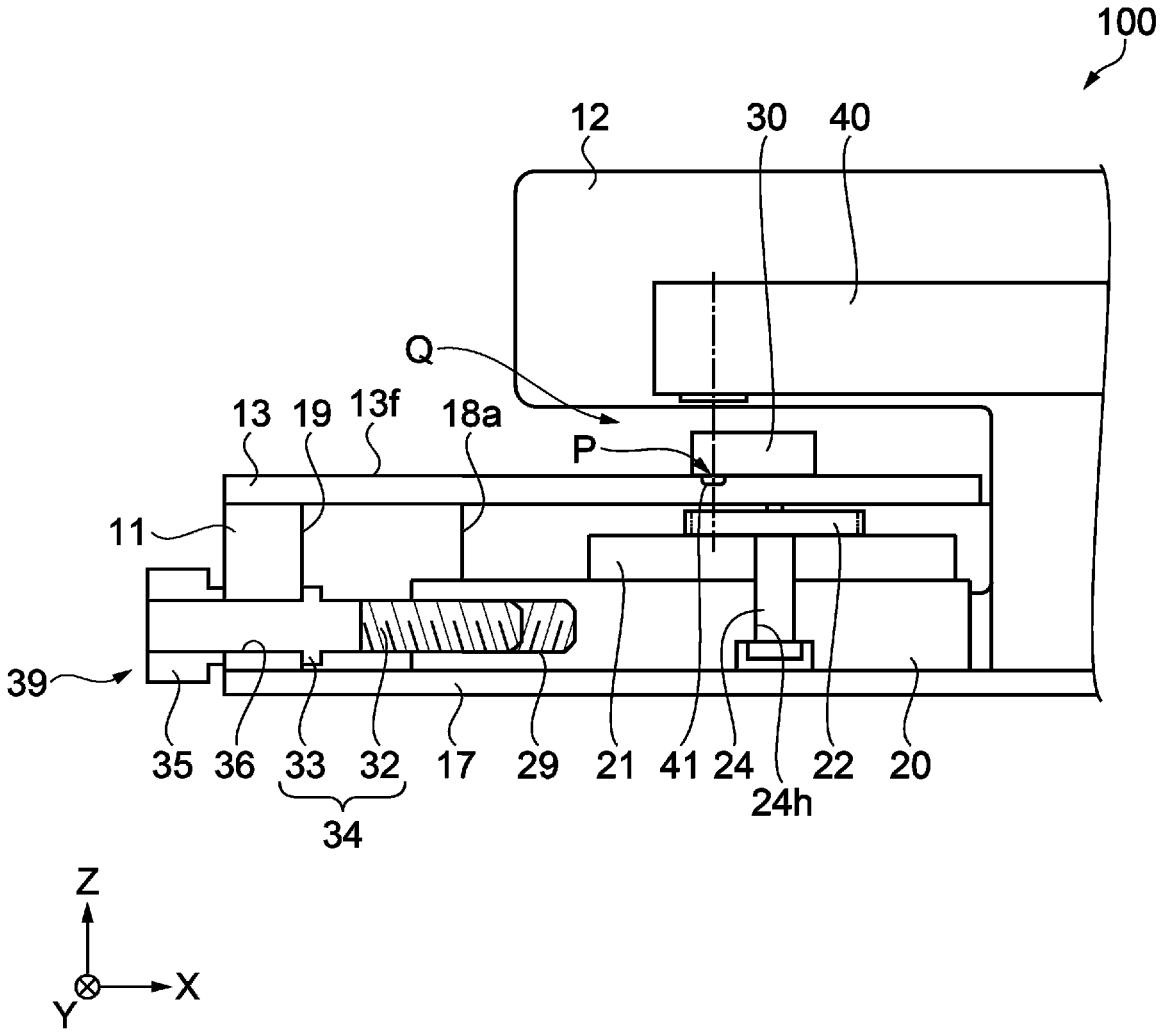
FIG. 3 is a sectional view illustrating a schematic configuration of the stapling device, taken along line III-III in FIG. 2.
Figure 4:
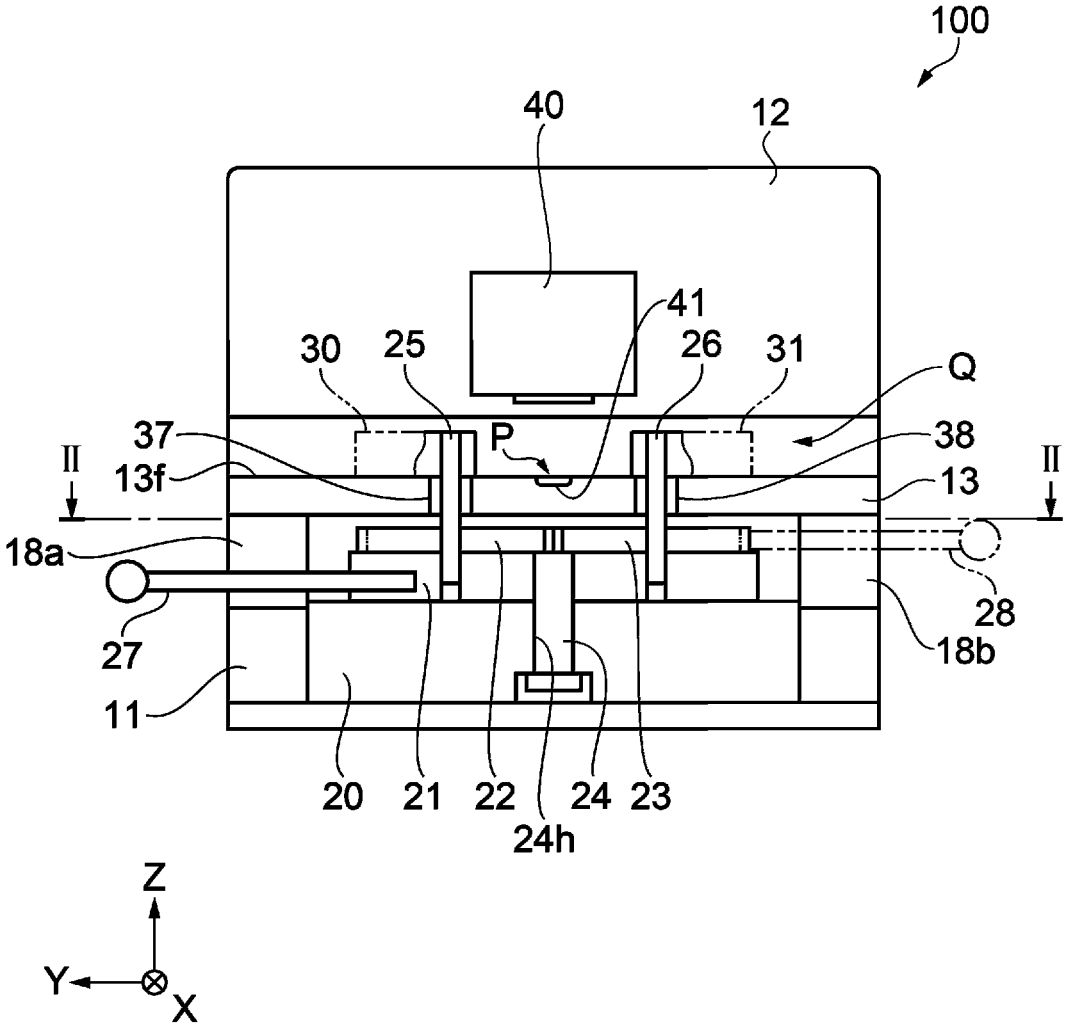
FIG. 4 is a sectional view illustrating a schematic configuration of the stapling device, taken along line IV-IV in FIG. 2.

First, a configuration of the stapling device according to a first embodiment will be described with reference to FIGS. 1, 2, 3, and 4. There is a case where the stapling device is called a stapler. FIG. 1 is an external perspective view illustrating a schematic configuration of the stapling device according to the first embodiment. FIG. 2 is a plan view illustrating a schematic configuration of the stapling device according to the first embodiment. In addition, for convenience of description, FIG. 2 illustrates a state where a main body upper section and the placement table are seen through, that is, a section taken along line II-II in FIG. 4. FIG. 3 is a sectional view illustrating a schematic configuration of the stapling device, taken along line in FIG. 2. FIG. 4 is a sectional view illustrating a schematic configuration of the stapling device, taken along line IV-IV in FIG. 2.

1.1. Schematic Configuration

First, a schematic configuration of a stapling device 100 according to the first embodiment will be described. As illustrated in FIG. 1, the stapling device 100 according to the first embodiment includes a main body section 10, a placement table 13 having a placement surface 13*f* on which the recording medium is placed, an operating section 39, a first guide member 30 and a second guide member 31 which are a pair of guide members disposed to be rotatable on the placement surface 13*f* side of the placement table 13, and a lower base 17.

The main body section 10 includes a main body lower section 11, a main body upper section 12, and a coupling section 14. The main body section 10 has the main body lower section 11 and the main body upper section 12 coupled to each other by the coupling section 14 positioned in the +X direction so as to have an insertion space Q between the main body lower section 11 and the main body upper section 12 for inserting a recording paper sheet as a recording medium and performing the binding processing. In other words, the main body section 10 has a configuration in which the main body lower section 11 and the main body upper section 12 are folded back via the coupling section 14. In addition, the main body upper section 12 is configured to have a shorter length from the coupling section 14 than the main body lower section 11, and can make it easy to perform the insertion of the recording paper sheet. The stapling device 100 can perform the binding processing for binding a plurality of recording paper sheets positioned by the first guide member 30 and the second guide member 31 in the insertion space Q.

On the upper surface of the main body lower section 11 on the insertion space Q side, the placement table 13 on which the recording paper sheet is placed is coupled by a fixing tool (not illustrated), such as a screw. On the lower surface of the main body lower section 11 opposite to the insertion space Q side, the lower base 17 is coupled by a fixing tool (not illustrated), such as a screw. The main body lower section 11 is provided with an accommodation section 19 (refer to FIG. 2) which will be described later. On a side surface of the main body lower section 11, a second window section 18*b* which is a window section that penetrates the accommodation section 19 is provided in a rectangular shape along the X axis, and a second operation lever 28 as a lever that can rotate the first guide member 30 and the second guide member 31 from the second window section 18*b* protrudes.

The operating section 39 includes a rotary knob 35, and by rotating the rotary knob 35, the first guide member 30 and the second guide member 31 can be moved relatively in the second direction with respect to the main body lower section 11 and the placement table 13.

1.2. Detailed Configuration and Operation

Next, the detailed configuration and the operation of the operating parts of the stapling device 100 according to the first embodiment will be described. As illustrated in FIGS. 3 and 4, a binding processing section 40 having a function of binding a plurality of recording paper sheets at a binding portion P positioned at an end portion of the recording paper sheet (not illustrated) as a plurality of recording media, is coupled to the main body upper section 12 that configures the main body section 10. The binding processing section 40 also includes a binding receiving section 41 provided at a position that corresponds to the binding portion P of the placement table 13 coupled to the upper surface of the main body lower section 11.

The binding processing section 40 including the binding receiving section 41 performs the binding processing for the plurality of recording paper sheets (hereinafter, "recording paper sheet bundle") in a state where the end portions of the plurality of recording paper sheets (not illustrated) are positioned at the binding portion P.

Although not illustrated, the binding processing section 40 performs the binding processing by a reciprocating movement of a movable section (not illustrated) positioned on the main body upper section 12 side in the Z direction. In addition, an electromagnetic driving mechanism, a drive motor, and the like can be used suitably for a moving unit of the movable section that configures the binding processing section 40. For driving such a moving unit, a configuration in which a switch for performing the binding processing is provided, or a configuration in which a sensor detects that the recording paper sheet bundle has been inserted into the binding processing section 40 and the binding processing is performed, can be used. Further, as the binding processing section 40, a configuration of a known type, such as of a type using a metal needle or of a type using no metal needle, can be used.

As illustrated in FIGS. 2, 3, and 4, in the main body lower section 11 that configures the main body section 10, the accommodation section 19 which is a space that corresponds to a region including the binding portion P is provided. The accommodation section 19 has a first side wall 19*a* in a direction in which the operating section 39 is provided, a second side wall 19*b* in the opposite direction, and a pair of side walls that couples the first side wall 19*a* and the second side wall 19*b* to each other, that is, a third side wall 19*c* in the +Y direction and a fourth side wall 19*d* in the −Y direction. The accommodation section 19 is sandwiched between the placement table 13 coupled to the upper surface of the main body lower section 11 and the lower base 17 coupled to the lower surface of the main body lower section 11.

In the accommodation section 19, a support base 20, a base 21 pivotally supported by a base shaft 24 so as to be rotatable with respect to the support base 20, and a first gear 22 and a second gear 23 which are a pair of gears that is disposed on the base 21 and respectively pivotally supported by gear shafts 25 and 26 so as to be rotatable with respect to the base 21, are accommodated in order from the lower base 17 side. In other words, the first gear 22 and the second gear 23 are disposed immediately below the placement table 13 and are accommodated in the accommodation section 19. The base 21 is provided at an opposite side of the placement table 13 from the side where the first guide member 30 and the second guide member 31 are arranged, and pivotally supports the first gear 22 and the second gear 23.

In addition, the gear shafts 25 and 26 pivotally support the first gear 22 and the second gear 23 with respect to the base 21, pass through escape holes 37 and 38 that penetrate the placement table 13, extend to the side opposite to the accommodation section 19 of the placement table 13, and are coupled to the first guide member 30 and the second guide member 31 as guide members. Specifically, the gear shaft 25 pivotally supports the first gear 22, passes through the escape hole 37 that penetrates the placement table 13, and are coupled to the first guide member 30. The gear shaft 26 pivotally supports the second gear 23, passes through the escape hole 38 that penetrates the placement table 13, and are coupled to the second guide member 31. Here, the escape holes 37 and 38 that penetrate the placement table 13 are provided as arc-shaped grooves as illustrated by two-dot chain lines in FIG. 2, respectively. The configuration of the escape holes 37 and 38 will be described in detail later.

The first gear 22 and the second gear 23 pivotally supported on the base 21 by the gear shafts 25 and 26 are arranged along the Y axis in a plan view from the Z axis direction, and are disposed so as to mesh with each other. In other words, the first gear 22 and the second gear 23 are interlocked with each other and rotate in opposite directions.

The second operation lever 28 is coupled to the second gear 23 as a lever that extends toward the second window section 18*b* positioned in the −Y direction. In addition, the second operation lever 28 protrudes from the second window section 18*b* to the outside of the main body lower section 11. The second gear 23 rotates the second operation lever 28 by moving the second operation lever 28 in a second operation lever moving direction m2 illustrated in FIG. 2, and the first gear 22 rotates in the opposite direction along with the rotation. In other words, the first guide member 30 and the second guide member 31 coupled to the first gear 22 and the second gear 23 are rotated in the directions opposite to each other by the movement operation of the second operation lever 28. In FIG. 2, the rotational directions of the first gear 22 and the second gear 23 are indicated by arrows r2 and r3.

The first guide member 30 and the second guide member 31 which are a pair of guide members are disposed on the placement surface 13*f* side of the placement table 13, and are respectively provided to be rotatable one by one on both sides with respect to the binding receiving section 41 that configures the binding processing section 40, that is, one by one on both sides with respect to the binding portion P.

Specifically, the first guide member 30 is disposed on the +Y direction side with respect to the binding portion P, and the second guide member 31 is disposed on the −Y direction side with respect to the binding portion P.

In addition, as a result of the rotating, the first guide member 30 and the second guide member 31 are fixed in a first posture of being disposed along the first direction that corresponds to the Y axis and a second posture which is a position disposed being open in the −X direction while an angle at which the extension lines intersect each other is approximately 90 degrees. In other words, the first guide member 30 and the second guide member 31 move between the first posture along the first direction and the position of the second posture inclined at an angle of approximately 45 degrees from the position of the first posture. The first posture refers to an aspect in which the first guide member 30 and the second guide member 31 are disposed along the first direction which is a direction in which one end side of the abutting recording paper sheet extends.

In this manner, by moving the second operation lever 28 as a lever and rotating the first gear 22 and the second gear 23 which are a pair of gears, the first guide member 30 and the second guide member 31 which are guide members are rotated in directions opposite to each other, and can easily rotate between the first posture and the second posture.

Further, in the aspect, the rotation centers of the first gear 22 and the second gear 23 are disposed along the Y axis and are concentrically provided with respect to a shaft center of the base shaft 24. In other words, as the base 21 rotates, the first gear 22 and the second gear 23 rotate around the shaft center of the base shaft 24. The base 21 can be rotated by moving the first operation lever 27 as a knob section.

The first operation lever 27 is coupled to the base 21 as a knob section that extends toward the first window section 18*a* positioned in the +Y direction. Here, the first window section 18*a* is a window section that penetrates the accommodation section 19 provided in a rectangular shape along the X axis on the side surface in the +Y direction of the main body lower section 11. In addition, the first operation lever 27 protrudes from the first window section 18*a* to the outside of the main body lower section 11. The base 21 rotates the first operation lever 27 in a base rotational direction r1 illustrated in FIG. 2 by moving the first operation lever 27 in a first operation lever moving direction m1 illustrated in FIG. 2, and the first gear 22 and the second gear 23 move along with the rotation. In other words, by moving the first operation lever 27 as the knob section, the first guide member 30 and the second guide member 31 that are pivotally supported by the first gear 22 and the second gear 23 can be rotated around the shaft center of the base shaft 24 of the base 21.

In the embodiment, a configuration in which the rotation center of the base 21 is provided on a line that couples the centers of the first gear 22 and the second gear 23 to each other, has been exemplified, but the embodiment is not limited thereto. The position of the rotation center of the base 21 can be a position overlapping the binding portion P, for example. In this case, even when the base 21 is rotated, the position of the binding portion P with respect to the recording paper sheet can be positioned inside the end side of the recording paper sheet.

Here, the configuration of the escape holes 37 and 38 of the placement table 13 through which the gear shafts 25 and 26 pass will be described. By rotating the base 21 as described above, the gear shafts 25 and 26 pivotally supported on the rotating base 21 are also rotated in the same manner. Therefore, the escape holes 37 and 38 of the placement table 13 through which the gear shafts 25 and 26 pass are provided as groove holes having an arc shape of which an inner angle exceeds 45 degrees along the concentric circle around the shaft center of the base shaft 24 as illustrated by a two-dot chain line in FIG. 2.

The support base 20 is attached to the main body lower section 11 of the main body section 10 so as to be movable along the second direction that corresponds to the X direction. The support base 20 of the configuration is exemplified as a rectangular base having a first outer surface 20*a* and a second outer surface 20*b* on both sides in the X direction, and a third outer surface 20*c* and a fourth outer surface 20*d* on both sides in the Y direction.

On the support base 20, each of the third outer surface 20*c* and the fourth outer surface 20*d* on both sides in the Y direction is disposed to be slidable with respect to each of the third side wall 19*c* and the fourth side wall 19*d* of the accommodation section 19 provided in the main body lower section 11. In other words, the support base 20 can move in the second direction using the third side wall 19*c* and the fourth side wall 19*d* of the accommodation section 19 as sliding guides.

Further, the support base 20 has a bearing hole 24*h* that corresponds to the base shaft 24 of the base 21. The support base 20 rotatably supports the base 21 by the base shaft 24 pivotally supported in the bearing hole 24*h*.

Further, the support base 20 has a female screw section 29 dug in the +X direction from the first outer surface 20*a*. By rotating a male screw section 32 of the operating section 39 attached by being screwed to the female screw section 29, while using the third side wall 19*c* and the fourth side wall 19*d* of the accommodation section 19 as guides, the support base 20 moves along the second direction between the first side wall 19*a* and the second side wall 19*b* of the accommodation section 19 as indicated by an arrow m3 in FIG. 2. By the movement of the support base 20 in the second direction, the first guide member 30 and the second guide member 31 can be moved in the second direction with respect to the placement table 13 coupled to the main body lower section 11 and the binding portion P.

The operating section 39 is provided in the main body lower section 11 positioned on the −X direction side where the recording paper sheet is inserted, that is, in the opposite direction to the binding portion P. The operating section 39 includes a rotational shaft 34 including a flange 33 and the rotary knob 35. The rotational shaft 34 is provided with the male screw section 32 screwed into the female screw section 29 of the support base 20 between the flange 33 and one end, and between the flange 33 and the other end, the rotary knob 35 is fixed to the end portion through a guide hole 36 that penetrates outward from the accommodation section 19 of the main body lower section 11. In other words, the rotational shaft 34 is rotatably held by the flange 33 and the rotary knob 35 with respect to the main body lower section 11.

In this manner, as the support base 20 moves in the second direction by the rotation operation of the operating section 39 provided in the main body lower section 11, the support base 21, and the first guide member 30 and the second guide member 31 which are pivotally supported via the base 21, the first gear 22, and the second gear 23 on the support base 20 can be moved in the second direction. Accordingly, the position of the binding portion P in the second direction with respect to the recording paper sheet can be easily changed.

1.3. Arrangement of Guide Members

Figure 5:
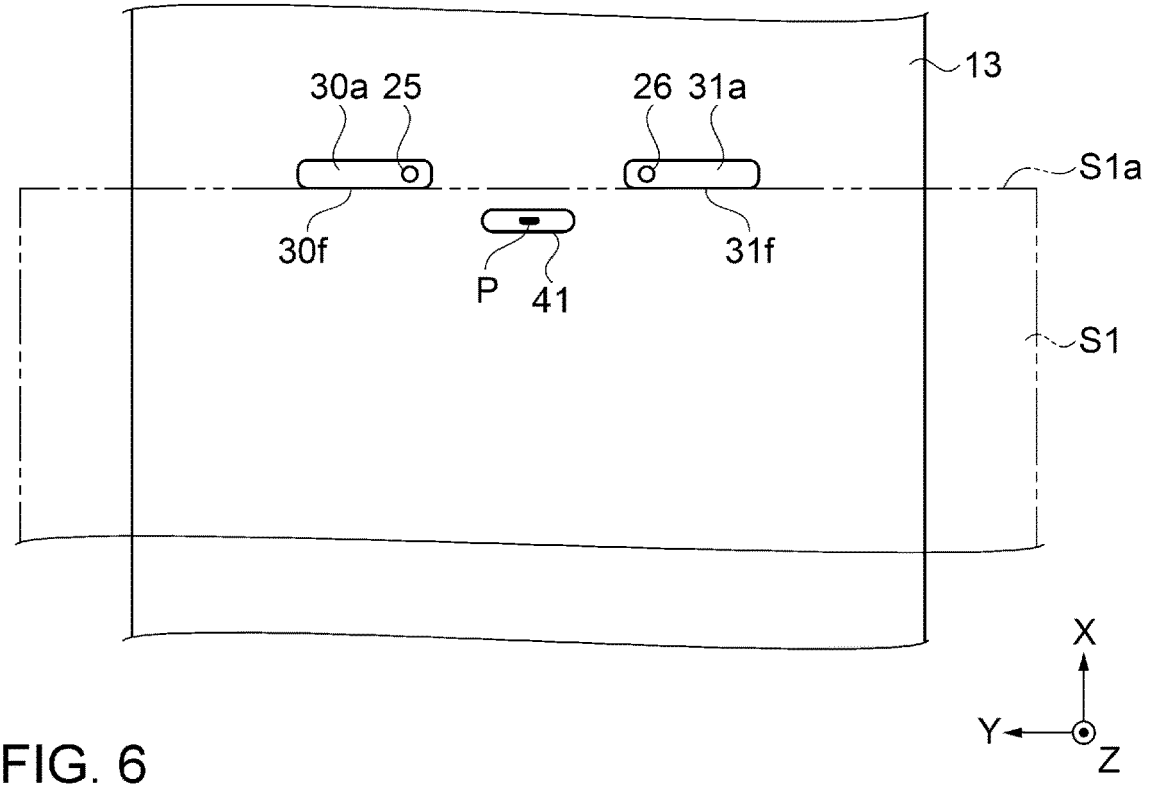
FIG. 5 is a plan view illustrating an arrangement example 1 of guide members of the stapling device according to the first embodiment.
Figure 6:
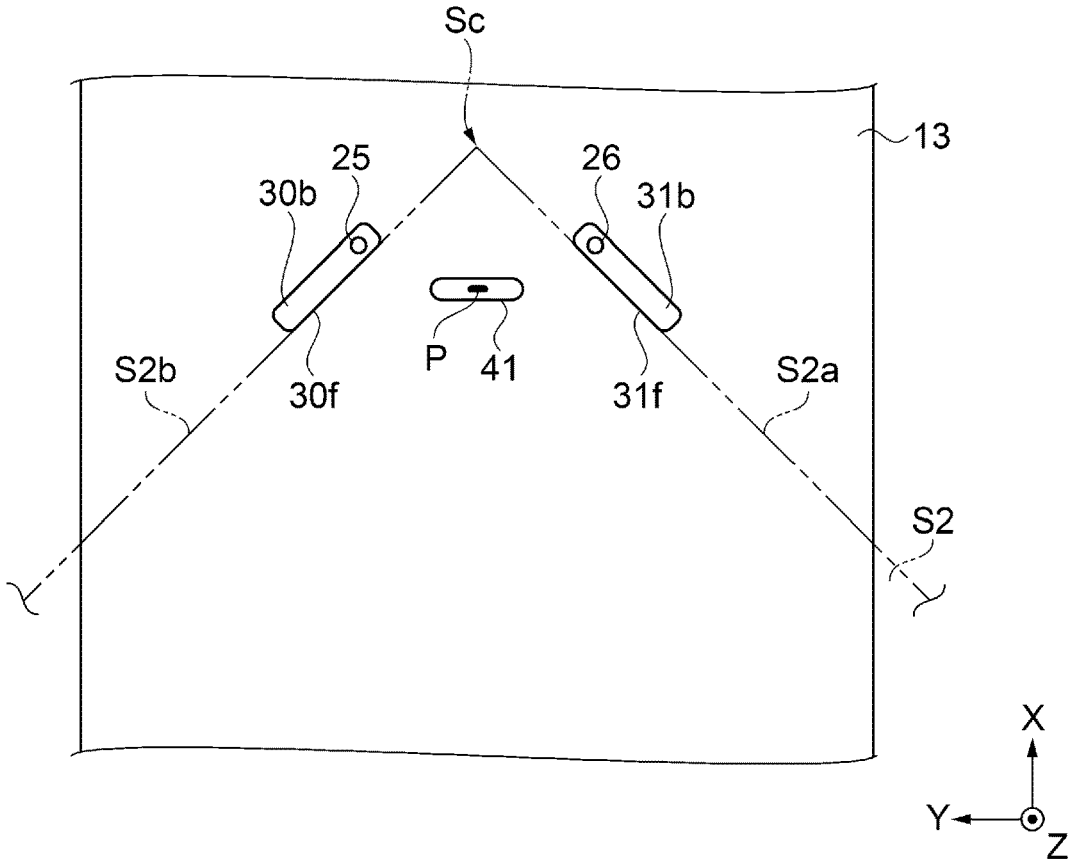
FIG. 6 is a plan view illustrating an arrangement example 2 of the guide members of the stapling device.
Figure 7:
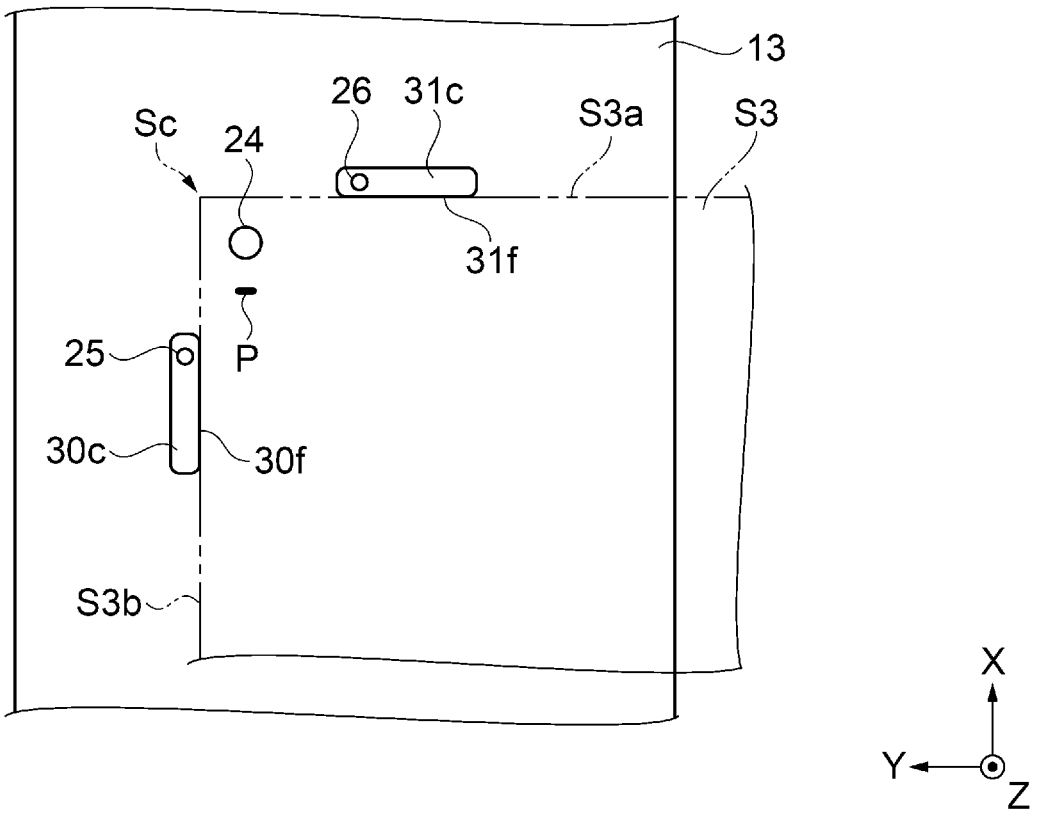
FIG. 7 is a plan view illustrating an arrangement example 3 of the guide members of the stapling device.

According to the stapling device 100 of the first embodiment described above, three patterns of guide members can be disposed on the recording paper sheet bundle formed of a plurality of recording paper sheets as recording media. In other words, according to the stapling device 100 of the first embodiment, the binding processing can be performed at the three binding positions and the binding directions. This will be described with reference to FIGS. 5, 6, and 7. FIG. 5 is a plan view illustrating an arrangement example 1 of the guide members of the stapling device according to the first embodiment. FIG. 6 is a plan view illustrating an arrangement example 2 of the guide members of the stapling device. FIG. 7 is a plan view illustrating an arrangement example 3 of the guide members of the stapling device.

First, in the arrangement example 1 illustrated in FIG. 5, the bundle of the recording paper sheet S1 is inserted onto the placement table 13 and the positioning of the recording paper sheet S1 is performed such that one end side S1*a* of a recording paper sheet S1 as a recording medium abuts against a guide surface 30*f* of the first guide member 30*a* and a guide surface 31*f* of the second guide member 31*a*. In addition, a case where the binding portion P is provided inside one end side S1*a* of the recording paper sheet S1 is exemplified.

In this case, the first guide member 30*a* and the second guide member 31*a* make a first posture of being disposed after being rotated along the rotations of the gear shafts 25 and 26 such that the guide surface 30*f* of the first guide member 30*a* and the guide surface 31*f* of the second guide member 31*a* are aligned along the first direction that corresponds to the Y axis. Here, when it is necessary to adjust the distance between the end side S1*a* of the recording paper sheet S1 and the binding portion P, the adjustment can be performed by moving the support base 20 (refer to FIG. 2) (not illustrated) by the rotation operation of the operating section 39.

Next, in the arrangement example 2 illustrated in FIG. 6, by inserting a corner portion Sc of the bundle of the recording paper sheet S2 first onto the placement table 13 such that one end side S2*a* of a recording paper sheet S2 as a recording medium and the other end side S2*b* that forms the corner portion Sc intersecting the end side S2*a* abut against a guide surface 30*f* of a first guide member 30*b* and a guide surface 31*f* of the second guide member 31*b*, the recording paper sheet S2 is positioned. In addition, a case where the binding portion P is provided inside the corner portion Sc at which the end side S2*a* and the end side S2*b* of the recording paper sheet S2 intersect each other is exemplified.

In this case, the first guide member 30*b* and the second guide member 31*b* make a second posture of being disposed after being rotated along the rotation of the gear shafts 25 and 26 such that the angle made by the guide surface 30*f* of the first guide member 30*b* and the guide surface 31*f* of the second guide member 31*b* is approximately 90 degrees and the guide surfaces are disposed to be open in the −X direction. In other words, the guide surface 30*f* of the first guide member 30*b* and the guide surface 31*f* of the second guide member 31*b* rotate to the second posture in a state of being moved in the closing direction until reaching approximately 90 degrees from the first posture in a state where the guide surfaces are open approximately 180 degrees. In addition, the rotation angle from the first posture to the second posture does not need to be increased to 90 degrees or more basically, and therefore, although not illustrated, a configuration that stops at each position, that is, a stopper is provided. Here, when it is necessary to adjust the distance between the corner portion Sc of the recording paper sheet S2 and the binding portion P, the adjustment can be performed by moving the support base 20 (refer to FIG. 2) (not illustrated) by the rotation operation of the operating section 39.

In this manner, by applying the arrangement example 1 and the arrangement example 2 and by rotating the rotatable first guide members 30*a* and 30*b* and the second guide members 31*a* and 31*b* as illustrated in the drawing, the user can easily determine the binding position of the two patterns by simple handling, and can bind a plurality of recording paper sheets.

Next, in the arrangement example 3 illustrated in FIG. 7, one end side S3*a* of a recording paper sheet S3 as a recording medium and the other end side S3*b* that forms the corner portion Sc intersecting the end side S3*a* abut against a guide surface 30*f* of a first guide member 30*c* and a guide surface 31*f* of the second guide member 31*c*. In this case, by inserting the corners portion Sc of the bundle of the recording paper sheets S3 on the placement table 13 from an oblique direction inclined with respect to the second direction, the recording paper sheet S3 is positioned. In addition, a case where the binding portion P of which the binding direction has changed by rotating the base 21 with respect to the binding direction illustrated in the arrangement example 2 is provided inside the corner portion Sc at which the end side S3*a* and the end side S3*b* of the recording paper sheet S3 intersect each other, is exemplified.

In this case, the first guide member 30*c* and the second guide member 31*c* make a third posture rotated by approximately 45 degrees by the rotation of the base 21 (refer to FIG. 2) from the second posture in which the angle made by the guide surface 30*f* of the first guide member 30*c* and the guide surface 31*f* of the second guide member 31*c* is approximately 90 degrees and the guide surfaces are disposed to be open in the −X direction. Here, when it is necessary to adjust the distance between the end side S3*a* of the recording paper sheet S3 and the binding portion P, the adjustment can be performed by moving the support base 20 (refer to FIG. 2) (not illustrated) by the rotation operation of the operating section 39.

In this manner, by applying the arrangement example 1, the arrangement example 2, and the arrangement example 3, and rotating the rotatable first guide members 30*a*, 30*b*, and 30*c* and the second guide members 31*a*, 31*b*, and 31*c* and rotating the base 21, the user can easily determine the binding position of the three patterns by simple handling, and can bind a plurality of recording paper sheets.

2. Second Embodiment

Figure 8:
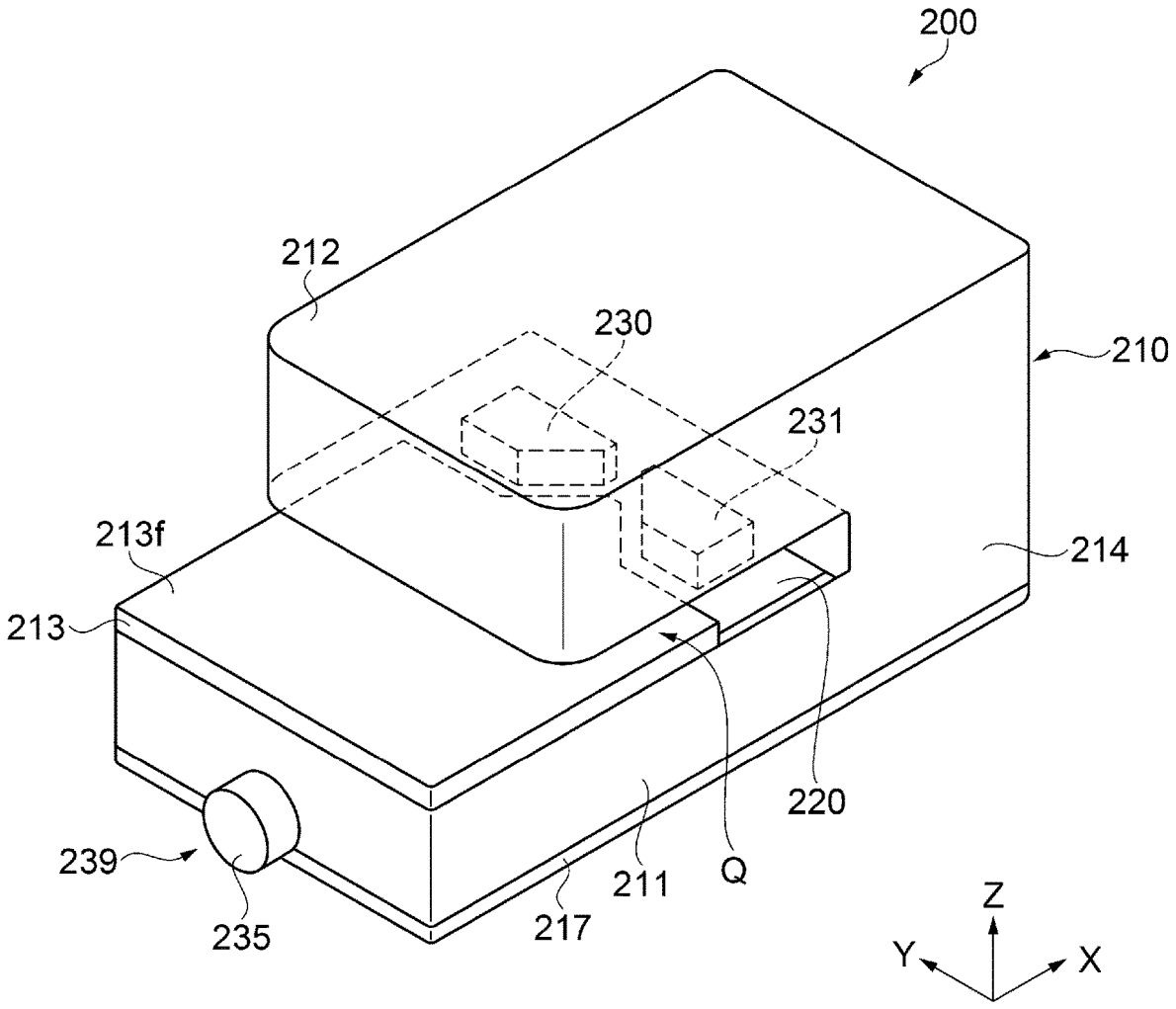
FIG. 8 is an external perspective view illustrating a schematic configuration of a stapling device according to a second embodiment.
Figure 9:
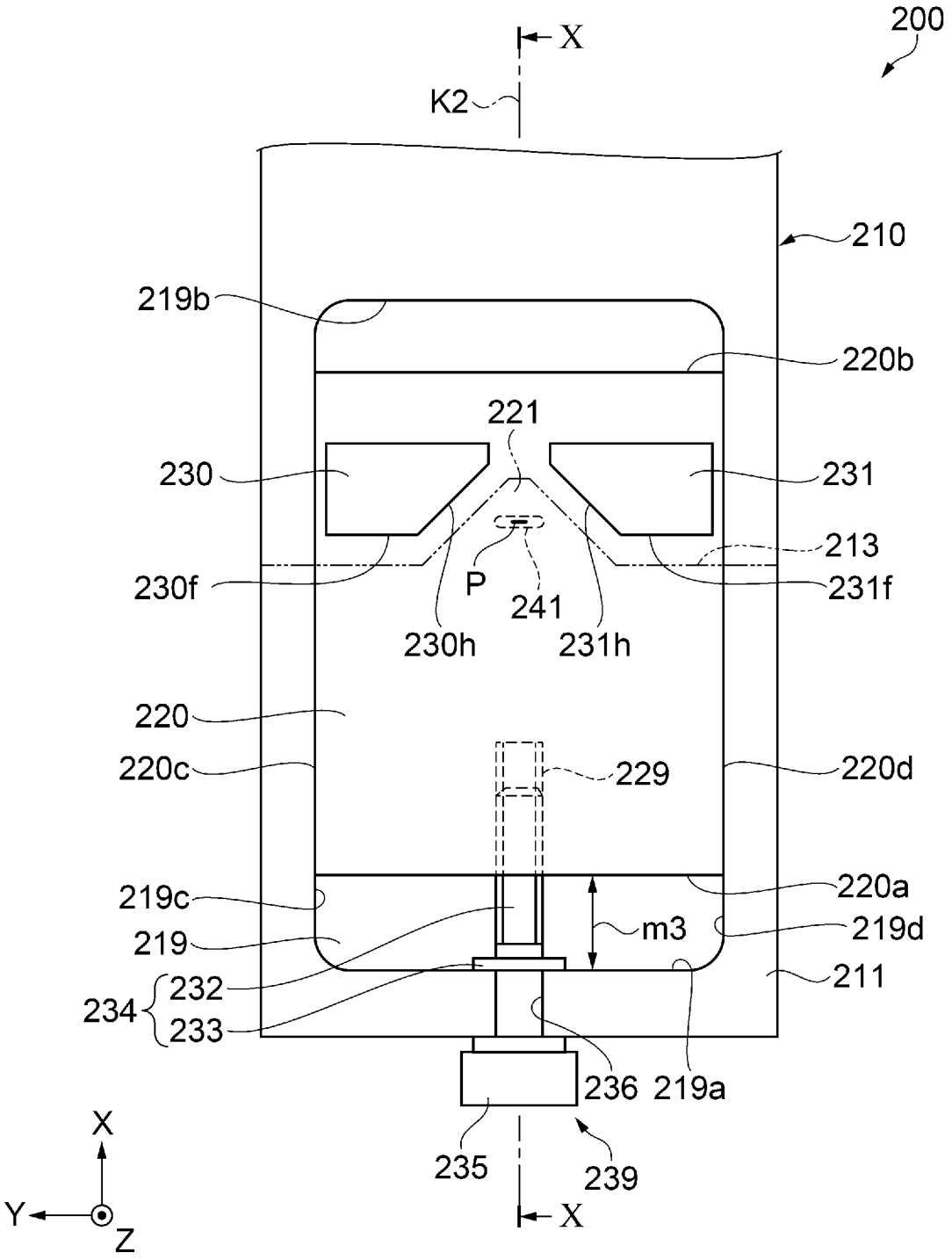
FIG. 9 is a plan view illustrating a schematic configuration of the stapling device according to the second embodiment.
Figure 10:
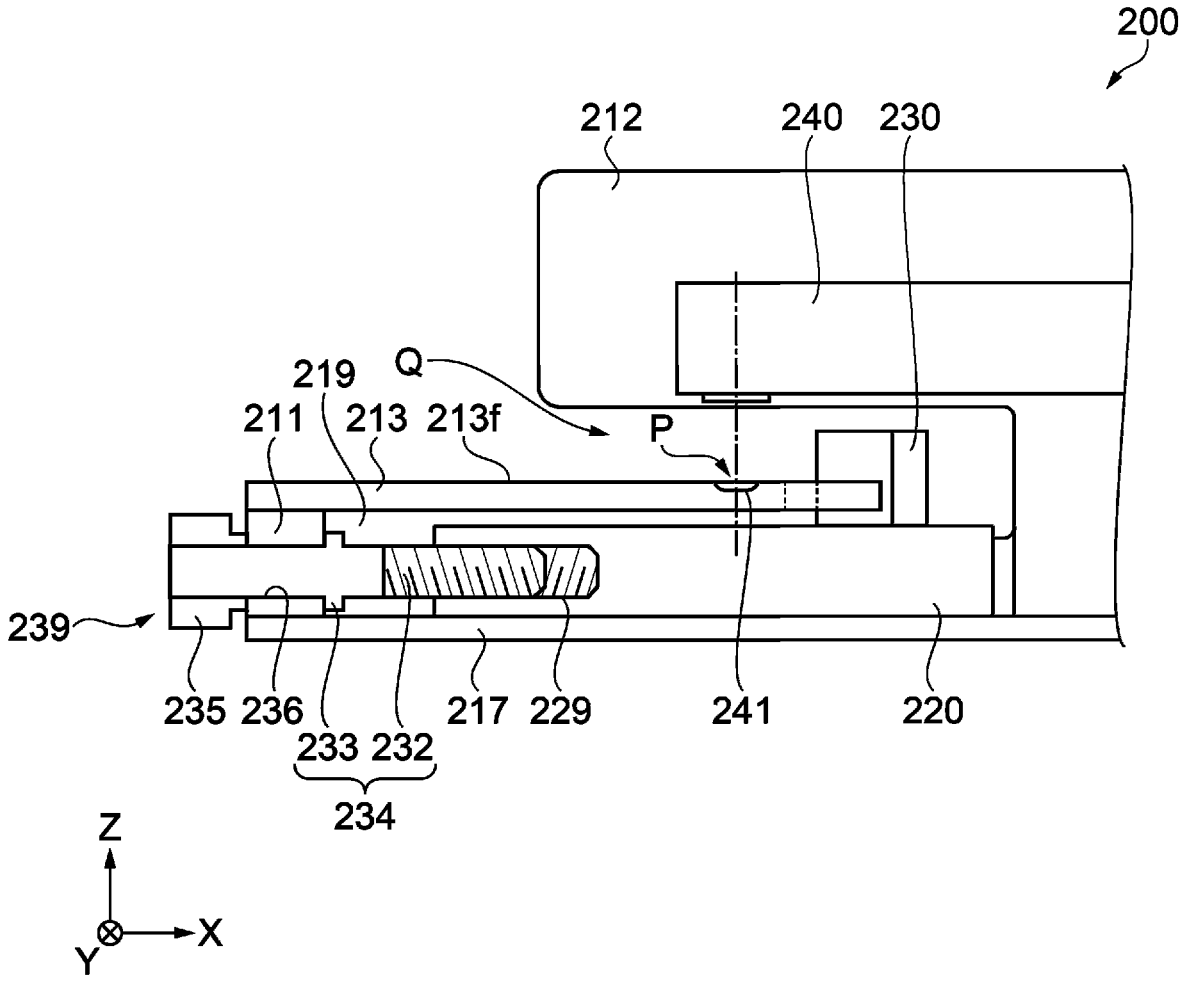
FIG. 10 is a sectional view illustrating a schematic configuration of the stapling device, taken along line X-X in FIG. 9.

Next, a configuration of the stapling device according to a second embodiment will be described with reference to FIGS. 8, 9, and 10. FIG. 8 is an external perspective view illustrating a schematic configuration of the stapling device according to the second embodiment. FIG. 9 is a plan view illustrating a schematic configuration of the stapling device according to the second embodiment. In addition, for convenience of description, FIG. 9 illustrates a state where the main body upper section and the placement table are seen through. FIG. 10 is a sectional view illustrating a schematic configuration of the stapling device, taken along line X-X in FIG. 9.

2.1. Schematic Configuration

First, a schematic configuration of a stapling device 200 according to the second embodiment will be described. As illustrated in FIG. 8, the stapling device 200 according to the second embodiment includes a main body section 210, a placement table 213 having a placement surface 213*f* on which the recording medium is placed, an operating section 239, a first guide member 230 and a second guide member 231 which are a pair of guide members provided on the placement surface 213*f* of the placement table 213, and a lower base 217.

The main body section 210 is configured similar to the first embodiment, and includes a main body lower section 211, a main body upper section 212, and a coupling section 214. The main body section 210 has the main body lower section 211 and the main body upper section 212 coupled to each other by the coupling section 214 positioned in the +X direction so as to have the insertion space Q between the main body lower section 211 and the main body upper section 212 for inserting the recording paper sheet as a recording medium and performing the binding processing. In other words, the main body section 210 has a configuration in which the main body lower section 211 and the main body upper section 212 are folded back via the coupling section 214. In addition, the main body upper section 212 is configured to have a shorter length from the coupling section 214 than the main body lower section 211, and can make it easy to perform the insertion of the recording paper sheet. The stapling device 200 can perform the binding processing for binding a plurality of recording paper sheets positioned by the first guide member 230 and the second guide member 231 in the insertion space Q.

On the upper surface of the main body lower section 211 on the insertion space Q side, the placement table 213 on which the recording paper sheet is placed is coupled by a fixing tool (not illustrated), such as a screw. In addition, on the lower surface of the main body lower section 211 opposite to the insertion space Q side, the lower base 217 is coupled by a fixing tool (not illustrated), such as a screw.

The operating section 239 includes a rotary knob 235 and by rotating the rotary knob 235, the first guide member 230 and the second guide member 231 can be moved relative to the X direction with respect to the main body lower section 211 and the placement table 213.

2.2. Detailed Configuration and Operation

Next, the detailed configuration and the operation of the operating parts of the stapling device 200 according to the second embodiment will be described. As illustrated in FIGS. 9 and 10, a binding processing section 240 having a function of binding the recording paper sheet bundle in the binding portion P positioned at the end portion of the recording paper sheet bundle (not illustrated) as a plurality of recording media, is coupled to the main body upper section 212 that configures the main body section 210. The binding processing section 240 also includes the binding receiving section 241 provided at a position that corresponds to the binding portion P of the placement table 213 coupled to the upper surface of the main body lower section 211.

The binding processing section 240 including the binding receiving section 241 performs the binding processing with respect to the plurality of recording paper sheet bundles in a state where the end portions of the plurality of recording paper sheets (not illustrated) are positioned in the binding portion P.

Although not illustrated, the binding processing section 240 moves in the Z direction to perform the binding processing. In addition, an electromagnetic driving mechanism, a drive motor, and the like can be used suitably for a moving unit of the binding processing section 240. For driving such a moving unit, a configuration in which a switch for performing the binding processing is provided, or a configuration in which a sensor detects that the recording paper sheet bundle has been inserted into the binding processing section 240 and the binding processing is performed, can be used. Further, as the binding processing section 240, a known type, such as a type using a metal needle or a type using no metal needle, can be used.

The placement table 213 is coupled to the upper surface of the main body lower section 211 in a region excluding the arrangement positions of the first guide member 230 and the second guide member 231 in a plan view from the +Z direction. The placement table 213 includes a convex portion 221 that protrudes between the first guide member 230 and the second guide member 231, and the binding receiving section 241 that corresponds to the binding processing section 240 and is provided at a position that corresponds to the binding portion P is provided in the convex portion 221.

In the main body lower section 211 that configures the main body section 210, the accommodation section 219 that corresponds to a region including the binding portion P is provided. The accommodation section 219 has a first side wall 219*a* in a direction in which the operating section 239 is provided, a second side wall 219*b* in the opposite direction, and a pair of side walls that couples the first side wall 219*a* and the second side wall 219*b* to each other, that is, a third side wall 219*c* in the +Y direction and a fourth side wall 219*d* in the −Y direction. The accommodation section 219 is sandwiched between the placement table 213 coupled to the upper surface of the main body lower section 211 and the lower base 217 coupled to the lower surface of the main body lower section 211.

The accommodation section 219 accommodates a support base 220 and the first guide member 230 and the second guide member 231 as a pair of guide members coupled to the upper surface of the support base 220. The support base 220 is coupled to a male screw section 232 that configures the operating section 239 by screw fitting, and is coupled to the main body lower section 211 by the operating section 239.

The support base 220 is attached to the main body lower section 211 of the main body section 210 so as to be movable along the second direction that corresponds to the X direction. The support base 220 of the configuration is a rectangular base having a first outer surface 220*a* and a second outer surface 220*b* on both sides in the X direction, and a third outer surface 220*c* and a fourth outer surface 220*d* on both sides in the Y direction.

On the support base 220, each of the third outer surface 220*c* and the fourth outer surface 220*d* on both sides in the Y direction is disposed to be slidable with respect to each of the third side wall 219*c* and the fourth side wall 219*d* of the accommodation section 219 provided in the main body lower section 211. In other words, the support base 220 can move in the second direction using the third side wall 219*c* and the fourth side wall 219*d* of the accommodation section 219 as guides.

Further, the support base 220 has a female screw section 229 dug in the +X direction from the first outer surface 220*a*. By rotating the male screw section 232 of the operating section 239 attached by being screwed to the female screw section 229, while using the third side wall 219*c* and the fourth side wall 219*d* of the accommodation section 219 as guides, the support base 220 moves along the second direction between the first side wall 219*a* and the second side wall 219*b* of the accommodation section 219 as indicated by an arrow m3 in FIG. 9. By the movement of the support base 220 in the second direction, the first guide member 230 and the second guide member 231 can be moved in the second direction with respect to the placement table 213 coupled to the main body lower section 211 and the binding portion P.

The first guide member 230 and the second guide member 231 are disposed one by one on both sides of the binding receiving section 241 positioned in the placement table 213, that is, on the both sides of the binding portion P, and are coupled to the upper surface of the support base 220. Specifically, the first guide member 230 is disposed on the +Y direction side with respect to the binding portion P, and the second guide member 231 is disposed on the −Y direction side with respect to the binding portion P.

The first guide member 230 and the second guide member 231 include: first surfaces 230*f* and 231*f* along the first direction in which one end side of the recording paper sheet (not illustrated) positioned outside the binding portion P extends; and second surfaces 230*h* and 231*h* that abut against any of two end sides that form the corner portion Sc of the recording paper sheet when the recording paper sheet is placed such that the corner portion Sc of the recording paper sheet (not illustrated) is positioned on an imaginary line K2 that passes through the binding portion P along the second direction.

In other words, the first guide member 230 has the first surface 230*f* along the first direction and the second surface 230*h* inclined by approximately 45 degrees with respect to the first surface 230*f*. In addition, the second guide member 231 has the first surface 231*f* along the first direction and a second surface 231*h* inclined by approximately 45 degrees with respect to the first surface 231*f*. The first guide member 230 and the second guide member 231 are provided in a substantially line-symmetric shape with respect to the imaginary line K2.

The first guide member 230 and the second guide member 231 have a configuration having a gap with respect to the convex portion 221 of the placement table 213, protruding to be closer to the main body upper section 212 than the placement surface 213*f* that is the upper surface of the placement table 213, and having the recording paper sheet inserted along the placement surface 213*f* of the placement table 213 abut against the guide members. In addition, a gap is provided between the first guide member 230 and the second guide member 231 and the convex portion 221 of the placement table 213, and accordingly, the first guide member 230 and the second guide member 231 can move in the second direction without interfering with the placement table 213.

The operating section 239 is provided in the main body lower section 211 positioned on the −X direction side where the recording paper sheet is inserted, that is, in the opposite direction to the binding portion P. The operating section 239 includes a rotational shaft 234 including a flange 233 and the rotary knob 235. The rotational shaft 234 is provided with the male screw section 232 screwed into the female screw section 229 of the support base 220 between the flange 233 and one end, and between the flange 233 and the other end, the rotary knob 235 is fixed to the end portion through a guide hole 236 that penetrates outward from the accommodation section 219 of the main body lower section 211. In other words, the rotational shaft 234 is rotatably held by the flange 233 and the rotary knob 235 with respect to the main body lower section 211.

In this manner, as the support base 220 moves in the second direction by the rotation operation of the operating section 239 provided in the main body lower section 211, the support base 220 and the first guide member 230 and the second guide member 231 which are coupled to the support base 220 can be moved in the second direction. Accordingly, the position of the binding portion P in the second direction with respect to the recording paper sheet can be easily changed.

2.3. Arrangement of Guide Members

Figure 11:
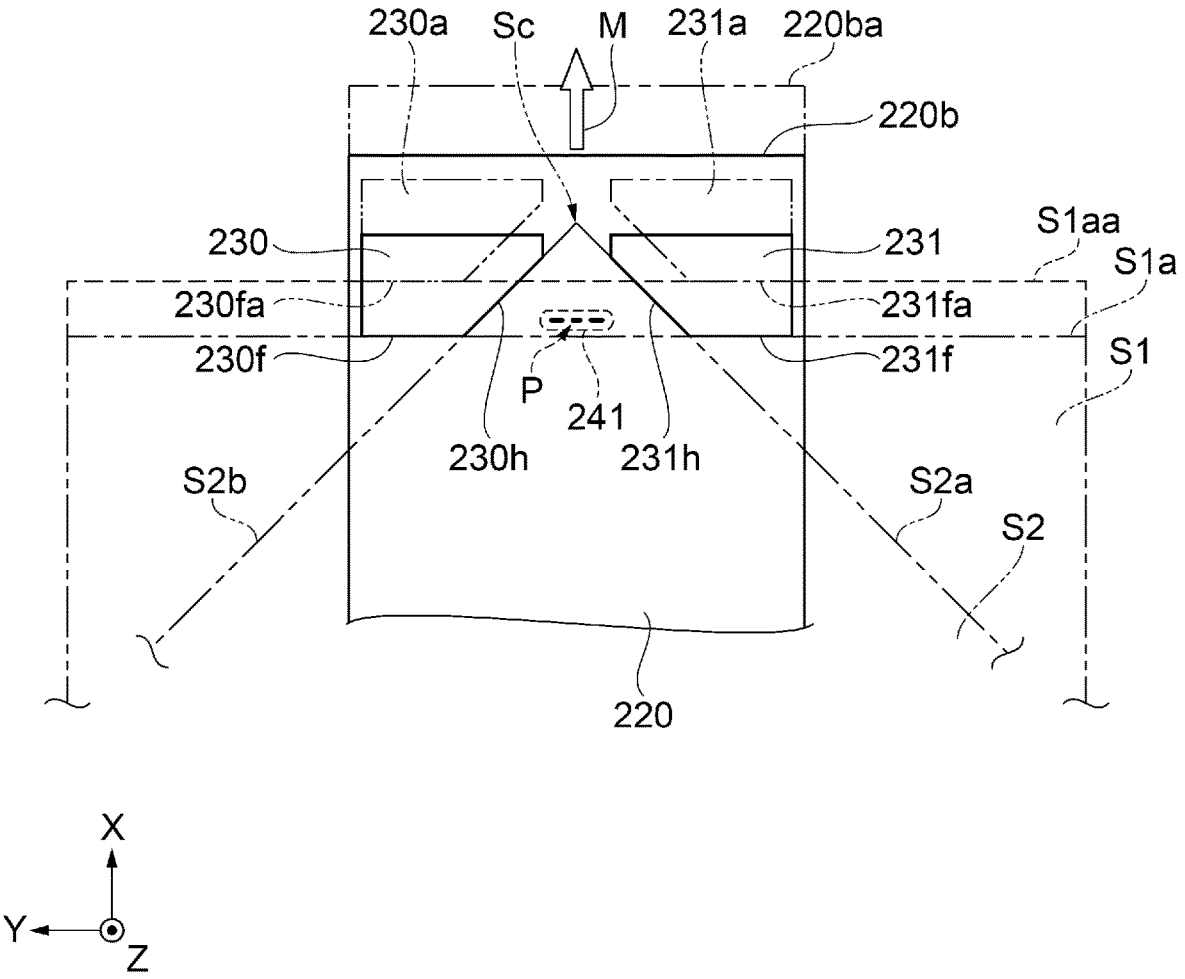
FIG. 11 is a plan view illustrating a correlation between a guide member and a binding portion of the stapling device according to the second embodiment.

According to the stapling device 200 of the second embodiment described above, the two patterns of guide members can be disposed with respect to the recording paper sheet bundle. In other words, according to the stapling device 200 of the second embodiment, the binding processing can be performed at the two binding positions and the binding directions. This will be described with reference to FIG. 11. FIG. 11 is a plan view illustrating a correlation between the guide member and the binding portion of the stapling device according to the second embodiment.

First, in the first aspect illustrated in FIG. 11, by inserting the bundle of the recording paper sheet S1 along the upper surface 231*f* (refer to FIG. 10) of the placement table 213 (refer to FIG. 10) such that one end side S1*a* of the recording paper sheet S1 as a recording medium abuts against the first surface 230*f* which is a guide surface of the first guide member 230 and the first surface 231*f* which is a guide surface of the second guide member 231, the recording paper sheet S1 is positioned. In addition, a case where the binding portion P is provided inside one end side S1*a* of the recording paper sheet S1 is exemplified.

In this case, the first surface 230*f* of the first guide member 230 and the first surface 231*f* of the second guide member 231 are disposed along the first direction that corresponds to the Y axis. Here, when it is necessary to adjust the distance between the end side S1*a* of the recording paper sheet S1 and the binding portion P, the adjustment can be performed by moving the support base 220 in the direction of an arrow M by the rotation operation of the operating section 239 (refer to FIG. 10). Specifically, the second outer surface 220*b* of the support base 220 moves to the position of a second outer surface 220*b*a after the movement indicated by the two-dot chain line. Along with the movement, the first guide member 230 and the second guide member 231 also move, and reach the positions of a first guide member 230*a* and a first surface 230*fa* indicated by the two-dot chain line, and the positions of a second guide member 231*a* and a first surface 231*fa*. The end side S1*a* of the recording paper sheet S1 that abuts against the first surface 230*fa* of the first guide member 230*a* and the first surface 231*fa* of the second guide member 231*a* can also be moved to the position of an end side S1*aa* indicated by the two-dot chain line. In this manner, the distance between the end side S1*a* of the recording paper sheet S1 and the binding portion P can be adjusted.

Next, in the second aspect illustrated in FIG. 11, by inserting the corner portion Sc of the bundle of the recording paper sheet S2 first along the upper surface 231*f* (refer to FIG. 10) of the placement table 213 (refer to FIG. 10) such that one end side S2*a* of the recording paper sheet S2 as a recording medium and the other end side S2*b* that forms the corner portion Sc intersecting the end side S2*a* abut against the second surface 230*h* of the first guide member 230 and the second surface 231*h* of the second guide member 231, the recording paper sheet S2 is positioned. In addition, a case where the binding portion P is provided inside the corner portion Sc at which the end side S2*a* and the end side S2*b* of the recording paper sheet S2 intersect each other is exemplified.

In this case, since the angle made by the second surface 230*h* of the first guide member 230 and the second surface 231*h* of the second guide member 231 is substantially 90 degrees and the surfaces are disposed to be open in the −X direction, the first guide member 230 and the second guide member 231 can easily insert the corner portion Sc in a state where the recording paper sheet S2 is inclined. Here, when it is necessary to adjust the distance between the corner portion Sc of the recording paper sheet S2 and the binding portion P, the adjustment can be performed by moving the support base 220 in the direction of the arrow M by the rotation operation of the operating section 239 (refer to FIG. 10).

According to the stapling device 200 of the second embodiment described above, by using the first guide member 230 and the second guide member 231 having the first surfaces 230*f* and 231*f* and the second surfaces 230*h* and 231*h* as two guide surfaces, the user can easily determine the binding position of the two patterns with simple handling, and can bind a plurality of recording paper sheets.

3. Third Embodiment

Figure 12:
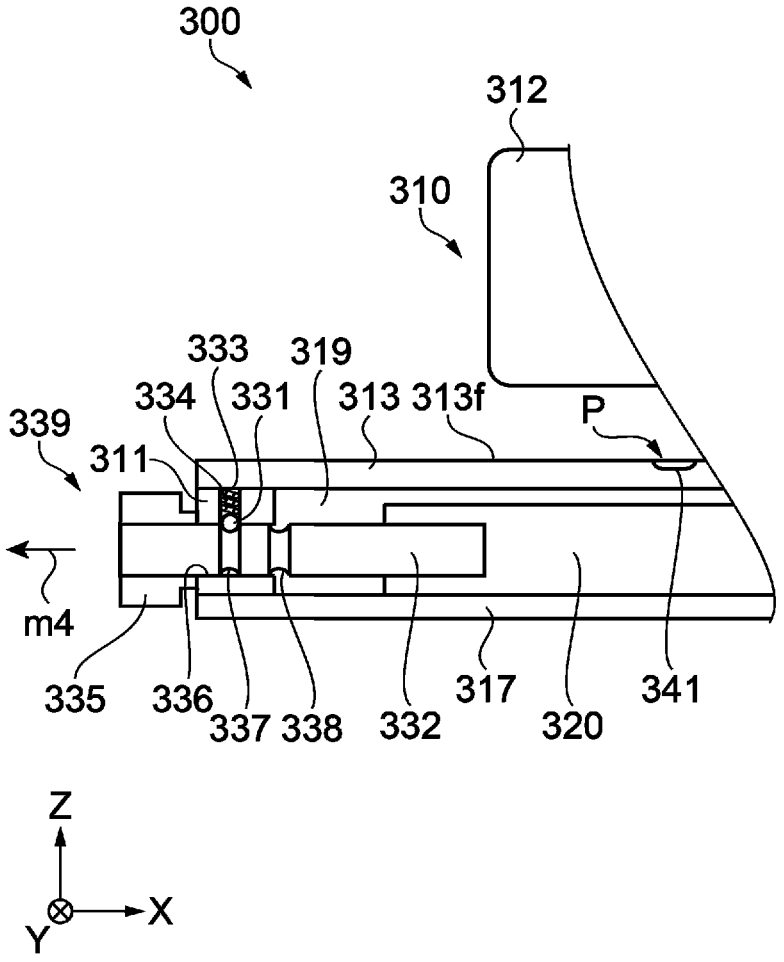
FIG. 12 is a sectional view illustrating a schematic configuration of a stapling device according to a third embodiment.

In the first and second embodiments described above, an example in which the movement of the support bases 20 and 220 in the second direction is performed by the rotation operations of the operating sections 39 and 239 including the rotational shafts 34 and 234 including the female screw sections 29 and 229 and the male screw sections 32 and 232 and the rotary knobs 35 and 235, has been described, but the disclosure is not limited to this configuration. Instead of this configuration, the support bases 20 and 220 according to the first and second embodiments can be moved in the second direction by using the configuration as that in a third embodiment illustrated in FIG. 12. Hereinafter, a stapling device 300 according to the third embodiment will be described with reference to FIG. 12, focusing on the configuration related to the movement of a support base 320 in the second direction. FIG. 12 is a sectional view illustrating a schematic configuration of the stapling device according to the third embodiment.

As illustrated in FIG. 12, the stapling device 300 according to the third embodiment can move the support base 320 in the second direction by a push/pull movement operation of a pushing and pulling section 339. The main body section 310 is configured similar to the first and second embodiments, and includes a main body lower section 311, a main body upper section 312, and a coupling section (not illustrated in FIG. 12). The main body section 310 has the main body lower section 311 and the main body upper section 312 coupled to each other by the coupling section positioned on one side in the +X direction so as to have an insertion space between the main body lower section 311 and the main body upper section 312 for inserting the recording paper sheet and performing the binding processing.

The placement table 313 is coupled to the upper surface of the main body lower section 311 similar to the first and second embodiments. The placement surface 313*f* of the placement table 313 is provided with a binding receiving section 341 that corresponds to the binding processing section (not illustrated in FIG. 12) and is provided at a position that corresponds to the binding portion P.

In the main body lower section 311 that configures the main body section 310, the accommodation section 319 that corresponds to a region including the binding portion P is provided. The accommodation section 319 is sandwiched between the placement table 313 coupled to the upper surface of the main body lower section 311 and the lower base 317 coupled to the lower surface of the main body lower section 311. The support base 320 is coupled to a shaft 332 that configures the pushing and pulling section 339, and is supported by the pushing and pulling section 339 on the main body lower section 311 so as to be movable in the second direction.

The pushing and pulling section 339 is provided in the main body lower section 311 positioned on the −X direction side where the recording paper sheet is inserted, that is, in the opposite direction to the binding portion P. The pushing and pulling section 339 includes the shaft 332 and a grip section 335. One end side of the shaft 332 is coupled to the support base 320, and is inserted into a slide guide section 336 that is a through hole that penetrates outward from the accommodation section 319 of the main body lower section 311, and the grip section 335 is fixed to the other end portion. The shaft 332 is supported by the main body lower section 311 in a state of being slidable in the X direction with respect to the main body lower section 311 using the slide guide section 336 as a guide.

The shaft 332 that configures the pushing and pulling section 339 is provided with two groove portions 337 and 338 that are recessed from the outer periphery. The main body lower section 311 is provided with a positioning hole 333 that penetrates the slide guide section 336 from the upper surface of the main body lower section 311 on the placement table 313 side. A spherical body 331 is inserted into the positioning hole 333 and is pressed against the shaft 332 by a coil spring 334.

In the illustration of FIG. 12, a first position where the spherical body 331 is fitted and pressed in the groove portion 337 provided on the shaft 332 is illustrated, and the pushing and pulling section 339 is held at the first position. Then, when the pushing and pulling section 339 is pulled out in a direction of an arrow m4, the spherical body 331 is detached from the groove portion 337 and stops at a second position where the spherical body 331 is fitted in the adjacent groove portion 338, and at the second position, the pushing and pulling section 339 is held.

In this manner, in the stapling device 300 according to the third embodiment, the support base 320 can move in the second direction by pushing or pulling the pushing and pulling section 339 coupled to the support base 320. In addition, the support base 320 can be easily positioned by applying a positioning structure including the groove portions 337 and 338, the spherical body 331, the coil spring 334, and the like.

Similarly, when the pushing and pulling section 339 applied to the stapling device 300 according to the third embodiment is used for moving the support bases 20 and 220 that configure the stapling devices 100 and 200 according to the first and second embodiments, the first guide members 30 and 230 (not illustrated) and the second guide members 31 and 231 (not illustrated) described above can be easily positioned.

4. Recording Apparatus

Figure 13:
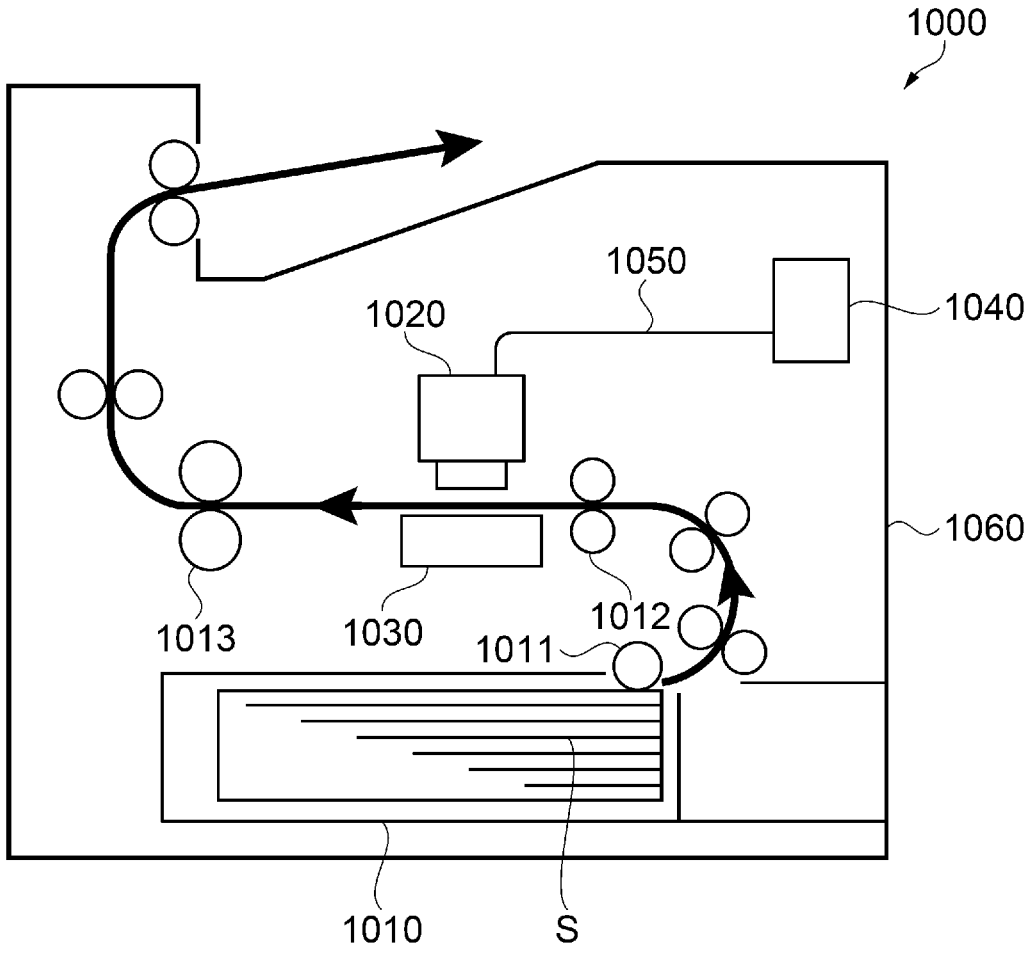
FIG. 13 is a schematic sectional view illustrating a configuration of a recording apparatus.
Figure 14:
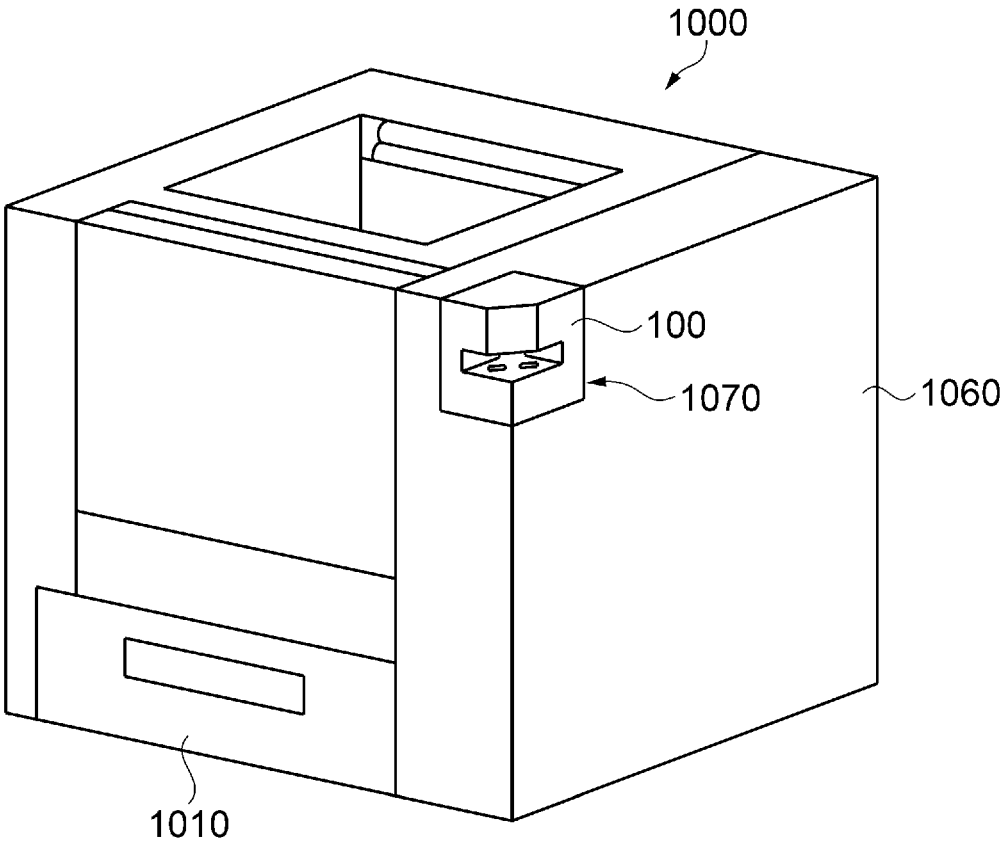
FIG. 14 is an external perspective view illustrating a schematic configuration of the recording apparatus.

Next, an ink jet printer will be exemplified as a recording apparatus to which any of the above-described stapling devices 100, 200, and 300 is applied, and will be described with reference to FIGS. 13 and 14. FIG. 13 is a schematic sectional view illustrating a configuration of the recording apparatus. FIG. 14 is an external perspective view illustrating a schematic configuration of the recording apparatus. In the following description, a configuration to which the stapling device 100 is applied will be described as an example.

As illustrated in FIGS. 13 and 14, an ink jet printer 1000 as an example of the recording apparatus includes a paper feed section 1010, a paper feed roller 1011, a transport roller 1012, a recording section including an ejection section 1020 and a paper receiving section 1030, an ink accommodation section 1040, a discharge roller 1013, a housing 1060 that accommodates these members, and the stapling device 100 which is attached to a part of the housing 1060 with an attaching section 1070.

The paper feed section 1010 stores the recording paper sheet S as a recording medium in an overlapping manner. The paper feed roller 1011 feeds one uppermost sheet of the recording paper sheets S stored in the paper feed section 1010 toward a transport path. The transport roller 1012 feeds the recording paper sheet S fed to the transport path to the recording section. The discharge roller 1013 discharges the recording paper sheet S on which the recording has been performed from a discharge section.

The ejection section 1020 ejects ink toward the recording paper sheet S by, for example, operation of a piezoelectric element, and records characters, images, and the like based on image information input from an input device, such as a personal computer, on the recording paper sheet S. The ejection section 1020 is provided at a predetermined position on the transport path. The paper receiving section 1030 is disposed to face the ejection section 1020 and receives the recording paper sheet S on which the recording is performed. The ink accommodation section 1040 accommodates ink and supplies the ink to the ejection section 1020 via an ink supply path 1050.

As illustrated in FIG. 14, the stapling device 100 is disposed in the attaching section 1070 provided at a corner part of the housing 1060. In the stapling device 100, a plurality of recording paper sheets S on which characters, images, and the like are recorded can be bound at a predetermined position. In this case, the user takes out the paper sheet bundle from the plurality of recording paper sheets S on which characters, images, and the like are recorded and which are stacked on a paper discharge tray provided outside the housing 1060, moves the paper sheet bundle to the position of the stapling device 100 while gripping the paper sheet bundle, and inserts the paper sheet bundle into the stapling device 100 to perform the binding processing with respect to the paper sheet bundle of the recording paper sheet S. In addition, by using the stapling device 100, the binding positions of the three patterns can be easily determined by simple handling, and a plurality of recording paper sheets can be bound.

In the description above, the ink jet printer 1000 is exemplified as the recording apparatus to which the stapling device 100 is applied, but the recording apparatus is not limited thereto. Examples of other recording apparatuses to which the stapling device 100 can be applied include ink jet recording apparatuses using other ink ejection methods, electrophotographic recording apparatuses, and offset printing machines.

In the description above, the recording apparatus to which the stapling device 100 is exemplified, but the stapling device 100 can also be applied to a scanner. In particular, in the scanner, it is necessary to remove staples when reading a document and it is effective when it is desired to perform the binding processing again after the reading is completed.

In the description above, as a recording medium to which the binding processing is performed, the recording paper sheet bundle using the recording paper sheets is exemplified, but the recording medium is not limited to paper sheets, and may be a medium on which characters or images can be recorded. Such a recording medium may be composed of another material, such as a synthetic resin (for example, a plastic film), wood, or ceramics.

Further, the present disclosure is not limited to the embodiments, and it is obvious that the embodiments can be modified as appropriate within the scope of the technical idea of the disclosure other than suggested in the embodiments. Further, the number, position, shape, and the like of the above-described configuration members are not limited to the embodiments, and can be set to a suitable number, position, shape, and the like for carrying out the disclosure.

Below, the contents derived from the above-described embodiments are described as each aspect.

Aspect 1

There is provided a stapling device according to the aspect including: a main body section; a binding processing section that is provided at the main body section and has a function of binding a plurality of recording media at a binding portion located at an end portion of a recording medium of the plurality of recording media; a pair of guide members that positions the plurality of recording media while an end side of the recording medium located outside the binding portion abuts against the guide members; and a placement table that is coupled to the main body section and has a placement surface on which the recording medium is placed, in which the guide members are disposed on both sides of the binding processing section on a side of the placement surface of the placement table such that the guide members are configured to each rotate, and are configured to rotate between a first posture along a first direction in which the end side that abuts against the guide members extends and a second posture inclined with respect to the first direction in line symmetry with an imaginary line that passes through the binding portion along a second direction orthogonal to the first direction in an extending direction of the placement surface.

According to the aspect, by the two guide members that can rotate the first posture along the first direction in which one of the abutting end sides of the recording medium extends and the second posture inclined with respect to the first direction in line symmetry with the imaginary line that passes through the binding portion along the second direction orthogonal to the first direction, the plurality of recording media can be positioned, and can be bound at the binding portion. More specifically, the recording medium can be placed such that one end side of the recording medium abuts against the guide member in the first posture, and the binding portion can be provided inside the end side. Further, by placing the recording medium such that the corner portion of the recording medium rotated by approximately 45 degrees is positioned between the two guide members moved from the first posture to the second posture, and the two end sides of the recording medium that forms the corner portion abuts against the two guide members moved to the second posture, the binding portion can be provided inside the corner portion. With such a configuration, the user can easily determine two binding positions with simple handling and bind a plurality of recording media. The term "orthogonal" here does not mean a strict right angle that intersects at 90 degrees, and may include an error of approximately 90 degrees±5 degrees.

Aspect 2

In the stapling device according to the above-described aspect, a base that is provided at an opposite side of the placement table from a side where the guide members are arranged, and pivotally supports a pair of gears may further be provided, and each of the guide members may be coupled to each of the gears, may be pivotally supported by a shaft that penetrates the placement table, and may move between the first posture and the second posture by rotating the gear.

According to this aspect, by rotating the pair of gears, the respective guide members can be easily rotated in the same direction between the first posture and the second posture.

Aspect 3

In the stapling device according to the above-described aspect, the gear may be provided with a lever coupled to the gear, and by movement of the lever, the gear may rotate and the guide member may rotate.

According to this aspect, the user can easily rotate the two guide members by moving the lever coupled to the gear.

Aspect 4

In the stapling device according to the above-described aspect, a support base that is attached to the main body section to be configured to move along the second direction, and to which the base is pivotally supported to be configured to rotate; and an operating section that is supported by the main body section in an opposite direction to the binding portion, in the second direction, may further be provided, and the support base may move in the second direction by a rotation operation of the operating section.

According to this aspect, as the support base moves along the second direction by the rotation operation of the operating section supported by the main body section, the base and the guide member pivotally supported by the base via the gear can be moved in the second direction. Accordingly, the position of the binding portion with respect to the recording medium can be easily changed. Further, by rotating the base pivotally supported by the support base, one type of binding position when the binding portion is provided inside the corner portion can be further added.

Aspect 5

In the stapling device according to the above-described aspect, a support base that is attached to the main body section to be configured to move along the second direction, and to which the base is pivotally supported to be configured to rotate; a pushing and pulling section that is coupled to the support base in an opposite direction to the binding portion, in the second direction; and a slide guide section that is provided in the main body section and guides movement of the pushing and pulling section along the second direction, may further be provided, and the support base may move in the second direction by a pushing and pulling operation of the pushing and pulling section.

According to this aspect, as the support base moves along the second direction by the pushing and pulling operation of the pushing and pulling section provided in the main body section, the base and the guide member pivotally supported by the base via the gear can be moved in the second direction. Accordingly, the position of the binding portion with respect to the recording medium can be easily changed.

Aspect 6

In the stapling device according to the above-described aspect, the base may include a knob section configured to move the guide member in a rotational direction.

According to this aspect, by moving the knob section provided on the base, the guide member can be easily rotated.

Aspect 7

There is provided a stapling device according to the aspect including: a main body section; a binding processing section that is coupled to the main body section and has a function of binding a plurality of recording media at a binding portion located at an end portion of a recording medium of the plurality of recording media; a pair of guide members that positions the plurality of recording media; and a placement table that is coupled to the main body section and has a placement surface on which the recording medium is placed, in which the guide members are disposed on both sides of the binding processing section, and have a first surface along a first direction in which one end side of the recording medium located outside the binding portion extends and a second surface that abuts against any of two end sides that form a corner portion of the recording medium when the recording medium is placed such that the corner portion is positioned on an imaginary line that passes through the binding portion along a second direction orthogonal to the first direction in an extending direction of the placement table.

According to this aspect, by the two guide members having the first surface along the first direction in which one end side of the recording medium extends and the second surface that abuts against any of two end sides that form the corner portion of the recording medium when the recording medium is placed such that the corner portion of the recording medium is positioned on the imaginary line that passes through the binding portion, the plurality of the recording media can be positioned and can be bound at the binding portion. More specifically, the recording medium can be placed such that one end side of the recording medium abuts against the first surface of the guide member, and the binding portion can be provided inside the end side. Further, by placing the recording medium such that the corner portion of the recording medium rotated by approximately 45 degrees is positioned on the imaginary line that extends in the second direction passing through the binding portion positioned between the two guide members, and the two end sides of the recording medium that forms the corner portion abuts against the second surface of the guide member, the binding portion can be provided inside the corner portion. With such a configuration, the user can easily determine two binding positions with simple handling and bind a plurality of recording media.

Aspect 8

In the stapling device according to the above-described aspect, a support base that is attached to the main body section such that the support base is configured to move along the second direction, may further be provided, and the guide member may be coupled to the support base and may move in the second direction together with the support base.

According to this aspect, the guide member can move in the second direction along with the support base coupled to the main body section so as to be movable along the second direction, and the position of the binding portion with respect to the recording medium on the placement table can be easily changed.

Aspect 9

In the stapling device according to the above-described aspect, an operating section that is supported by the main body section in an opposite direction to the binding portion, in the second direction, may further be provided, and the support base may move in the second direction by a rotation operation of the operating section.

According to this aspect, the support base and the guide member coupled to the support base can move along the second direction by the rotation operation of the operating section, and the position of the binding portion in the second direction with respect to the recording medium can be easily changed.

Aspect 10

In the stapling device according to the above-described aspect, a pushing and pulling section that is coupled to the support base in an opposite direction to the binding portion, in the second direction; and a slide guide section that is provided at the main body section and supports the pushing and pulling section to be configured to slide, may further be provided, and the support base may move in the second direction by a pushing and pulling operation of the pushing and pulling section.

According to this aspect, the support base and the guide member coupled to the support base can move along the second direction by the pushing and pulling operation of the pushing and pulling section, and the position of the binding portion in the second direction with respect to the recording medium can be easily changed.

Aspect 11

There is provided a recording apparatus according to the aspect including: a recording section that performs recording on a recording medium; and the stapling device according to the above-described aspect.

According to the recording apparatus of this aspect, the recording medium on which the recording is performed by the recording section can be bound by the stapling device that can easily determine two binding positions by simple handling.

What is claimed is:

1. A stapling device comprising:

a main body section;

a binding processing section that is provided at the main body section and has a function of binding a plurality of recording media at a binding portion located at an end portion of a recording medium;

a pair of guide members that positions the plurality of recording media while an end side of the recording medium located outside the binding portion abuts against the guide members;

a placement table that is coupled to the main body section and has a placement surface on which the recording medium is placed; and a base that is provided at an opposite side of the placement table from a side where the guide members are arranged, and pivotally supports a pair of gears, wherein the guide members are disposed on both sides of the binding processing section on a side of the placement surface of the placement table such that the guide members are configured to each rotate, and are configured to rotate between a first posture along a first direction in which the end side that abuts against the guide members extends and a second posture inclined with respect to the first direction in line symmetry with an imaginary line that passes through the binding portion along a second direction orthogonal to the first direction in an extending direction of the placement surface, and wherein each of the guide members is coupled to each of the gears, is pivotally supported by a shaft that penetrates the placement table, and moves between the first posture and the second posture by rotating the gear.

2. The stapling device according to claim 1, wherein the gear is provided with a lever coupled to the gear, and by movement of the lever, the gear rotates and the guide member rotates.

3. The stapling device according to claim 1, further comprising:

a support base that is attached to the main body section to be configured to move along the second direction, and to which the base is pivotally supported to be configured to rotate; and an operating section that is supported by the main body section in an opposite direction to the binding portion, in the second direction, wherein the support base moves in the second direction by a rotation operation of the operating section.

4. The stapling device according to claim 1, further comprising:

a support base that is attached to the main body section to be configured to move along the second direction, and to which the base is pivotally supported to be configured to rotate;

a pushing and pulling section that is coupled to the support base in an opposite direction to the binding portion, in the second direction; and a slide guide section that is provided in the main body section and guides movement of the pushing and pulling section along the second direction, wherein the support base moves in the second direction by a pushing and pulling operation of the pushing and pulling section.

5. The stapling device according to claim 1, wherein the base includes a knob section configured to move the guide member in a rotational direction.

6. A stapling device comprising:

a main body section;

a binding processing section that is coupled to the main body section and has a function of binding a plurality of recording media at a binding portion located at an end portion of a recording medium;

a pair of guide members that positions the plurality of recording media;

a placement table that is coupled to the main body section and has a placement surface on which the recording medium is placed; and a support base that is attached to the main body section such that the support base is configured to move along a second direction, wherein the guide members are disposed on both sides of the binding processing section, and have a first surface along a first direction in which one end side of the recording medium located outside the binding portion extends and a second surface that abuts against any of two end sides that form a corner portion of the recording medium when the recording medium is placed such that the corner portion is located on an imaginary line that passes through the binding portion along the second direction orthogonal to the first direction in an extending direction of the placement surface, wherein the guide member is coupled to the support base and moves in the second direction together with the support base.

7. The stapling device according to claim 6, further comprising:

an operating section that is supported by the main body section in an opposite direction to the binding portion, in the second direction, wherein the support base moves in the second direction by a rotation operation of the operating section.

8. The stapling device according to claim 6, further comprising:

a pushing and pulling section that is coupled to the support base in an opposite direction to the binding portion, in the second direction; and a slide guide section that is provided at the main body section and supports the pushing and pulling section to be configured to slide, wherein the support base moves in the second direction by a pushing and pulling operation of the pushing and pulling section.

9. A recording apparatus comprising:

a recording section that performs recording on a recording medium; and the stapling device according to claim 1.

* * * * *